United States Patent [19]

Pinkerton et al.

[11] 4,067,139

[45] Jan. 10, 1978

[54] ELECTRIC POWERED FLYING MODEL AIRPLANE

[75] Inventors: Kenneth R. Pinkerton, Cypress; Douglas J. Malewicki, Tustin, both of Calif.

[73] Assignee: L. M. Cox Manufacturing Co., Inc., Santa Ana, Calif.

[21] Appl. No.: 705,979

[22] Filed: July 16, 1976

[51] Int. Cl.[2] ..... A63H 27/12; A63H 29/02

[52] U.S. Cl. ..... 46/249; 46/77

[58] Field of Search ..... 46/77, 249

[56] References Cited

U.S. PATENT DOCUMENTS

| | | | |
|---|---|---|---|
| 3,579,905 | 5/1971 | Radford | 46/249 |
| 3,803,758 | 4/1974 | Chang et al. | 46/249 |
| 3,807,087 | 4/1974 | Staats et al. | 46/249 |

FOREIGN PATENT DOCUMENTS

| | | | |
|---|---|---|---|
| 595,896 | 4/1960 | Canada | 46/249 |

*Primary Examiner*—Louis G. Mancene
*Assistant Examiner*—Robert F. Cutting
*Attorney, Agent, or Firm*—Knobbe, Martens, Olson, Hubbard & Bear

[57] ABSTRACT

An electrically powered scale model airplane is disclosed in which a rechargeable electric storage battery is positioned within the aircraft fuselage to balance the weight of a nose mounted direct drive motor. A switch for energizing the motor driving the propeller is arranged to be adjusted from an "off" position to an "on" position by remotely operated control cables acting through a bellcrank assembly used to change the orientation of the aircraft elevator during flight, thus allowing the aircraft to be operated by a single individual. The switch may be manually operated to an "off" position from the outside of the aircraft fuselage in preparation for recharging of the battery. In addition, the entire connecting means between the storage batteries, the recharging battery switch assembly, and the propeller motor are made by only three rigid wires within the aircraft fuselage, two of these wires providing switch contacts for energizing the motor, thus greatly reducing the overall cost of assembling this device.

23 Claims, 4 Drawing Figures

ELECTRIC POWERED FLYING MODEL AIRPLANE

BACKGROUND OF THE INVENTION

This invention relates to flying model airplanes, and more specifically, to electrically powered scale model airplanes of the U-control type, that is, of the type which is controlled in circular flight by an operator manipulating a pair of control wires from the center of the circular flight path.

U-control model airplanes and, specifically, gas powered model airplanes, have been manufactured for many years. Typically, these airplanes include an extremely lightweight gasoline powered engine which operates at high RPM and permits scale models to be designed without particular concern that the aircraft will be nose heavy in comparison with the full scale aircraft which is being emulated.

More recently, flying model airplanes using electric motors and rechargeable dry cells have been produced, but attempts to build scale models of full size aircraft using electric motors have typically required long drive shafts between the relatively heavy electric drive motor and the nose mounted propeller in order to shift the center of gravity toward the rear of the aircraft and thus balance the aircraft while in flight. Such long drive shaft arrangements often result in higher model costs, since additional bearings other than the bearings within the motor themselves must be positioned and mounted in the nose of the aircraft. Furthermore, the long drive shaft often requires an extra part to be assembled into the aircraft, since most small high speed motors are designed with a relatively short armature shaft.

Prior art model airplanes of the electrically driven type are usually difficult for one person to operate, since a switch must be closed at the aircraft to start the electric motor and the operator must be positioned at the center of the flight circle to fly the aircraft. A prior attempt at permitting an operator to remotely operate a switch from the circle center is shown in U.S. Pat. No. 3,696,558. In this patent, however, no easy means is provided for setting the switch in the "off" position during battery charging and later closing the switch from the circle center using the normal bellcrank control lines, all while assuring that manipulation of the bellcrank will not later open the switch.

Wiring within model electric airplanes has often been a problem. Since recharging of the chargeable dry cells must be provided from outside of the airplane, a switch must be provided for breaking the circuit between the rechargeable batteries and the motor, and spring contacts must be provided for the rechargeable dry cells. Often, a substantial portion of the cost of producing an electric model airplane can be the assembly of wiring within the airplane to interconnect the various parts thereof. In addition, since the rechargeable cells can be damaged by reverse polarization during charging, elaborate and costly arrangements have been provided in the prior art for assuring proper charging polarity.

SUMMARY OF THE INVENTION

These and other difficulties encountered in the prior art of manufacturing electric scale model flying aircraft are overcome by the present invention. This invention includes a nose mounted, short armature shaft electric motor. The armature shaft supports and directly drives a nose mounted propeller. In order to balance the aircraft, the rechargeable batteries used for driving the electric motor are mounted aft of the wing in a position selected to precisely counterbalance the weight of the motor mounted forward in the fuselage. In addition, a bellcrank activated switch is provided which permits the motor to be disconnected from the rechargeable dry cells by means of a switch actuator on the fuselage body. The switch itself is maintained in an open configuration by a frictional engagement of a switching element on the switch actuator. The switch actuator is connected to be tripped by motion of the elevator control bellcrank and to be spring biased, by the switch contact itself, out of the normal path of the tripping mechanism once the switch has been closed. Thus, a circle center positioned operator may manipulate the bellcrank to one extreme, tripping the switch actuator and overcoming frictional engagement between the actuator and the switch contact, permitting the resilience of the switch contact to move the switch actuator out of position, thus closing the switch and starting the electric motor. The spring bias of the switch contact moves the switch actuator a sufficient distance so that the tripping mechanism cannot interfere with normal operation of the bellcrank in controlling the elevator position once the motor has been started.

The invention also provides a complete interconnection of the motor, the switch, the rechargeable battery, and the charging battery using three resilient conductive wires, two of these wires having ends which provide the contacts for the switch. These wires are of sufficient diameter to be self-supporting within the fuselage of the flying scale model and may be rapidly connected in place, as by melting plastic body parts therearound. This simple wiring configuration, using relatively rigid, resilient wires which provide the resilient contacts for the rechargeable battery as well as the resilient contacts for the switch substantially reduces the labor, time, and costs required in the assembly and manufacturing of such model aircraft.

The fuselage, recharging contacts, and rear wheel of the model are arranged in such a manner as to prevent the accidental reverse polarity hook-up of a charging battery. These and other advantages of the present invention are best understood through a reference to the drawings, in which.

DETAILED DESCRIPTION OF THE PREFERRED EMBODIMENT

Figure 1:
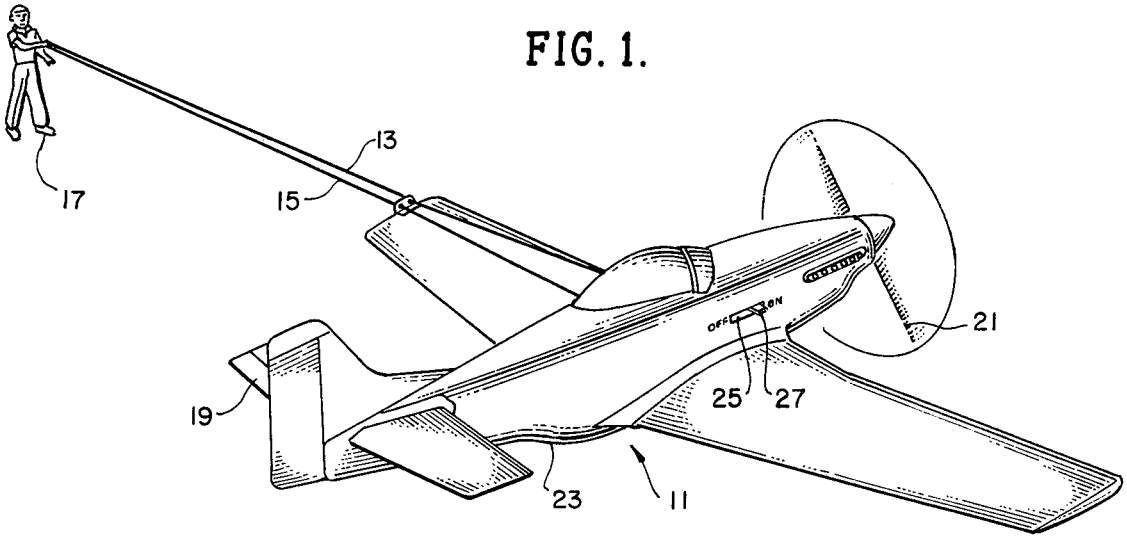
FIG. 1 is a perspective view of the electrically powered flying scale model of the present invention operated by a person standing at the flight circle center position in a U-control fashion.

Referring initially to FIG. 1, the electrically powered flying scale model aircraft 11 of the present invention is shown being controlled in circular flight through a pair of control lines 13 and 15 by an operator 17 positioned at the center of the flight circle. The airplane 11 includes an elevator 19, the position of which is controlled by the relative position of the control lines 13, 15 manipulated by the operator 17 in typical U-control fashion. A propeller 21 driven by an electric motor within the fuselage 23 of the model airplane 11 drives the aircraft 11. Mounted on the side of the fuselage 23 and extending through an aperture 25 therein, a switch actuator 27 is used prior to flight to disengage the motor driving the propeller 21 from a rechargeable battery.

As will be more clearly understood from the detailed description which follows, the operator 17, through a proper manipulation of the control lines 13, 15, can manipulate the switch actuator 27 from the "off" position to the "on" position while standing at the center of the flight circle remote from the airplane 11, so that, without assistance, he can grasp the end of the control lines 13 and 15, start the aircraft motor, and fly the airplane 11.

Figure 2:
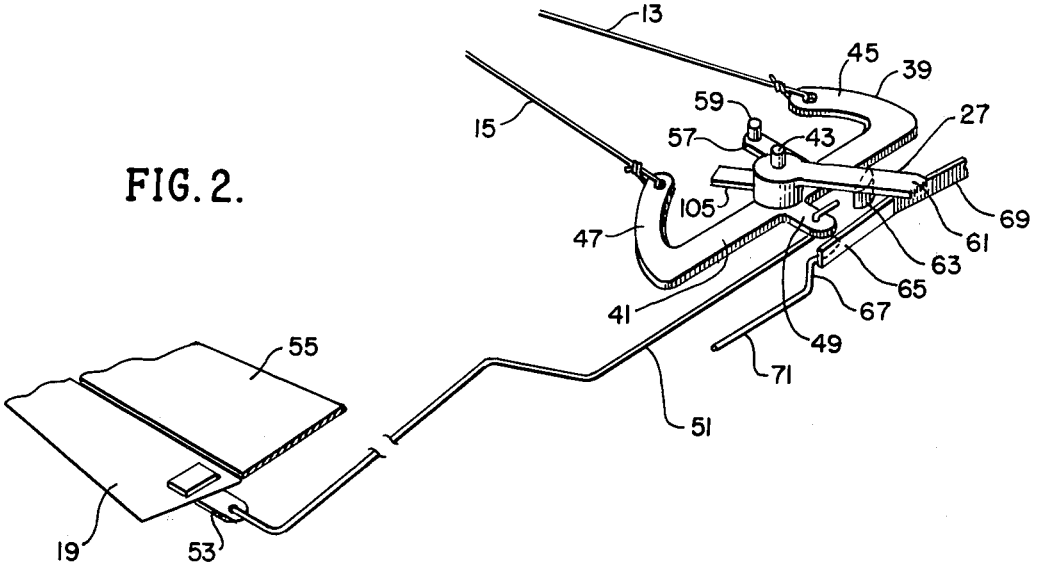
FIG. 2 is a broken away perspective view of the bellcrank, push rod, and elevator assembly mounted within the fuselage of the model aircraft of FIG. 1 and showing the operation of the switch actuator and switch contact in response to movement of the bellcrank in accordance with the present invention.
Figure 3:
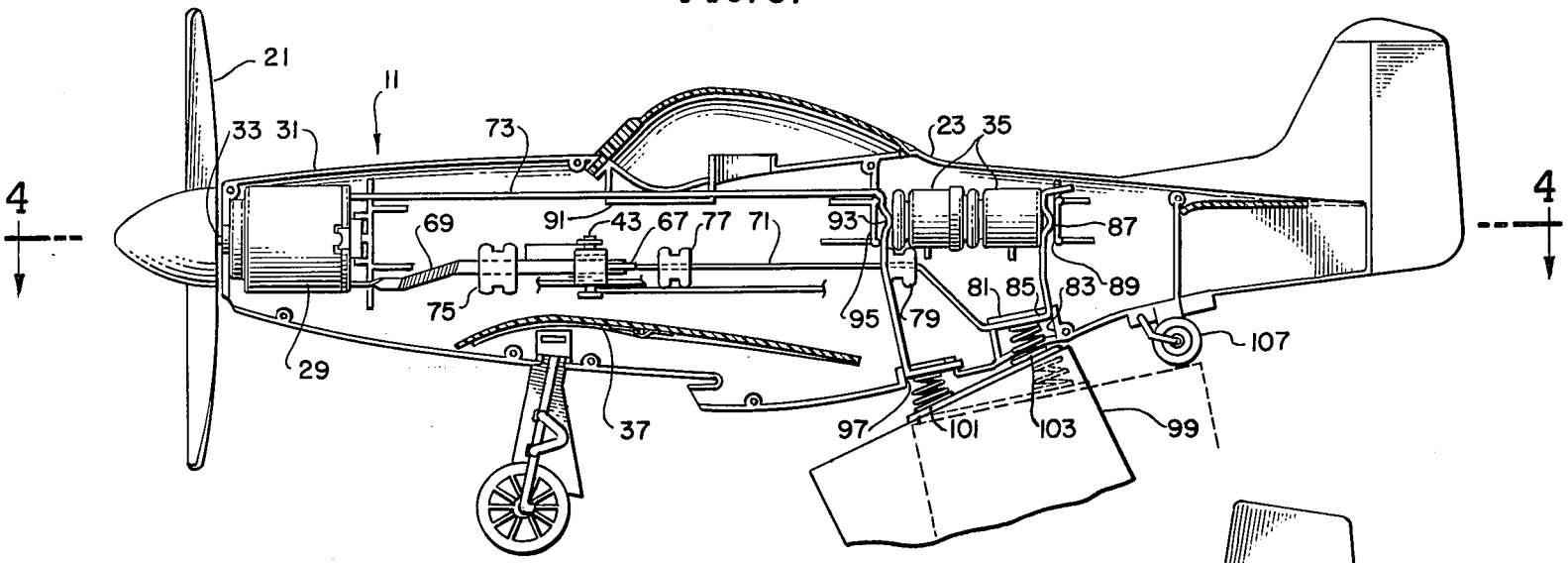
FIG. 3 is a longitudinal sectional view of the center of the fuselage of the aircraft of FIG. 1 showing the location of the driving elements as well as the interconnecting wiring therefor and the positioning of the switch actuating bellcrank.
Figure 4:
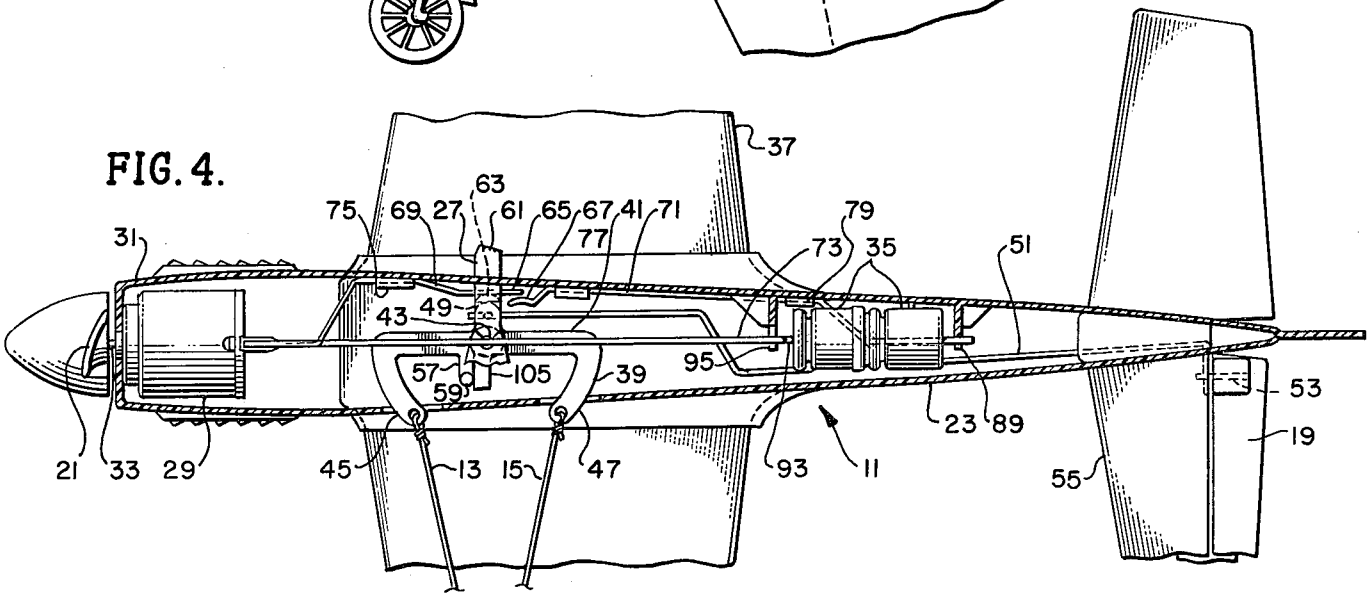
FIG. 4 is a sectional view taken along the lines 4—4 of FIG. 3 showing the wiring configuration and bellcrank operated switch of this invention.

Referring now to FIGS. 2, 3, and 4, the detailed construction of the airplane 11 will be described. This airplane is a scale flying model, that is, the overall proportions are a close replica of a full scale flying airplane. An electric motor 29 is mounted in the nose 31 of the fuselage 23 and includes a relatively short armature shaft 33 connected to support the propeller 21 for direct driving. The motor 29 is substantially heavier in proportion to the weight of the remainder of the aircraft 11 than is the gasoline powered motor on the full scale aircraft emulated by the model. In order to counterbalance this weight in what would otherwise be a nose heavy model, a pair of rechargeable batteries 35 are located within the fuselage 23 aft of the wing 37. In the design of the model, the position of the batteries 35 was selected to place the center of gravity of the flying model 11 at a point coincident with the center of lift of the wing 37.

In a typical fashion, the control lines 13 and 15 are connected to a bellcrank 39 which includes a main body section 41 pivotally mounted on a stationary axle 43 and including a pair of laterally extending arms 45 and 47 for connection to the control lines 13 and 15, respectively. A control lever 49 extends from the main body portion 41 on the side opposite the arms 45 and 47 and includes an aperture for rotatably receiving a hooked end of a control rod 51 which extends to the tail of the airplane 11. The other end of the control rod 51 is rotatably mounted on a second bellcrank 53 rigidly attached to the elevator 19. Thus, rotation of the bellcrank 39 by relative movement of the control lines 13 and 15 rotates the elevator 19 about its interconnection with the aircraft stabilizer 55 to adjust the trim of the aircraft and control the flight altitude.

The bellcrank 39 includes an additional arm 57 laterally extending on the same side as the arms 45 and 47, the distal end of the arm 57 supporting an upstanding cylindrical release pin 59.

Also pivotally mounted on the axle 43 and free to rotate independent of the bellcrank 39, the switch actuator 27 is formed of non-conductive material such as plastic and includes a distal end 61 which extends outside of the aircraft fuselage 23. Extending below the switch actuator 27 at a location just inside the wall of the fuselage 23, a crescent-shaped extension 63 is used to actuate the switch for energizing the motor 29 of the aircraft 11. This switch is provided by the two ends 65 and 67 of a pair of interconnecting, self-supporting wire leads 69 and 71, respectively. The self-supporting leads 69 and 71 and an additional self-supporting lead 73 provide the entire electrical interconnection for the aircraft 11. The first lead 69 is a flat, relatively thick copper ribbon engaged at one extremity in a friction electric contact within the motor 29. The body of the conductor 69 is supported within the fuselage 23 by a plastic nib 75 which is melted over the conductor 69 after this conductor 69 is placed against the interior wall of the fuselage 23. The remaining flat end of the conductor 69 is bent to form the resilient switch member 65 having a relaxed position separated from the wall of the fuselage 23 as best shown in FIG. 4.

The second conductor 71 is a relatively heavy gauge round copper wire bent at one end to form a relatively rigid switch contact 67. This switch contact 67 is spaced from the wall of the fuselage 23 by a distance of less than the relaxed spacing distance of the resilient switch member 65 so that the resilient switch member 65 is normally biased against the stationary switch contact 67 to electrically interconnect the conductors 69 and 71. The main body of the conductor 71 is held in place on the interior of the fuselage 23 by a pair of plastic nibs 77 and 79 which are fused over the wire 71 during the assembly operation. The end of the conductor 71 opposite the switch contact 67 is bent to pass beneath a shelf 81 forming the bottom of a cup-shaped cavity 83 in the underside of the fuselage 23. That portion 85 of the conductor 71 which passes through the cup-shaped aperture 83 is thus open to the outside of the fuselage 23 for charging the rechargeable batteries, as will be explained in more detail below. From the portion 85, the conductor 71 is bent to form a resilient spring contact section 87 fitted between a rigidly supported lateral wall member 89 and one of the rechargeable batteries 35. The spring contact section 87 resiliently biases this end of the conductor 71 between the wall 89 and battery 35 to support the end of the conductor 71.

The third conductor 73 is formed from a relatively stiff copper rod, one end of which is flattened for frictional engagement with a second electrical contact of the motor 29. The body of the conductor 73 is maintained in mating grooves 91 in facing halves of the fuselage 23 and extends to a resilient spring contact section 93 on the alternate end of the battery pair 35. As with the spring contact 87, the spring contact 93 is resiliently biased between the batteries 35 and a lateral wall member 95 to maintain the position of the conductor 73 and at the same time assure contact with the batteries 35. The remaining end of the conductor 73 extends through apertures to cross the floor wall of a second cup-shaped aperture 97 in the bottom of the fuselage 23, thus providing a second contact point for recharging the batteries 35.

As can be seen in dotted lines in FIG. 3, a dry cell 99 having resilient contacts 101 and 103 may be pressed against the bottom of the fuselage 23 so that the resilient contacts 101 and 103 enter the cup-shaped apertures 97 and 83 and make electrical contact with the wires 71 and 73, thus providing a direct electrical interconnection between the dry cell 99 and the rechargeable battery pair 35 for recharging the batteries 35. During such recharging operation, the switch contacts 65 and 67 are disconnected in a manner to be described below so that the motor 29 is not energized. It can be seen from the discussion above that the three rigid conductors are self-supporting within the fuselage 23; that is, by simply mounting these wires at several points, the remaining wire remains in place as mounted. These three wires provide the entire interconnection between the dry cell 99, the rechargeable batteries 35, the switch 65, 67, and the motor 29, reducing manufacturing assembly costs in terms of labor and materials and increasing the reliability of the flying model.

As previously stated, the resilient switch contact 65 is biased against the stationary switch contact 67. Manipulation of the switch actuator 27, and specifically the distal end 61 thereof, from outside the fuselage 23 to a position as shown in FIG. 4 will frictionally engage the crescent-shaped member 63 against the resilient spring contact 65, moving the spring contact 65 toward the wall of the fuselage 23 and out of engagement with the stationary contact 67. Since the actuator 27 can be brought to a position perpendicular to the resilient switch contact 65, this contact bears against the crescent-shaped member 63 directly toward the axle 43. The actuator 27 is stable in the position shown in FIG. 4 and maintained in this position by the friction between the resilient member 65 and the crescent-shaped member 63. With the switch so opened, the dry cell 99 may be used to recharge the batteries 35. After the charging operation, the operator may step to the circle center position as shown in FIG. 1 and relatively move the control lines 13 and 15 to rotate the bellcrank 39 in a counterclockwise direction as viewed in FIG. 4. This rotation will bring the member 59 into contact with an arm 105 of the switch actuator 27 which extends from the axle 43 in a direction opposite the end 61, rotating the switch actuator 27 counterclockwise to a position where the resilience of the spring contact 65 overcomes the friction between the spring contact 65 and the crescent-shaped member 63. Further movement of the spring contact 65 rapidly rotates the switch actuator 27 to its extreme counterclockwise position. As shown in FIG. 4, this position removes the arm 105 from the normal movement path of the member 59 so that the switch 65, 67 cannot be opened by movement of the bellcrank 39 during flight and so that the arm 105 cannot interfere with normal operation of the bellcrank 39.

The cup-shaped apertures 97 and 83 in the underside of the fuselage 23 are located in close proximity to the rigidly projecting tailwheel 107 to prevent the reverse engagement of the resilient contacts 101 and 103 of the recharging dry cell 99. The body portion of the dry cell 99 will clear the tailwheel 107 when inserted in proper polar contact as shown in FIG. 3, however it will prevent contact between conductor 71 at portion 85 and resilient contact 101 when inserted in the wrong or reverse position as shown in the dotted lines. Thus, the accidental depolarization of the motor operating dry cells 35 is prevented.

This invention, therefore, includes a simplified mechanism for wiring an electric scale model flying airplane, utilizing three relatively rigid self-supporting conductors to interconnect the dry cell 99, batteries 35, switch 65, 67, and motor 29. This interconnection permits a placement of the rechargeable batteries 35 aft of the wing 37 to counterbalance the weight of the relatively heavy electric motor 29. The switch 65, 67 in conjunction with the bellcrank 39 and actuator 27 permits remote control of the switch 65, 67 from an "off" position to an "on" position, but not in a reverse direction. In addition, the switch permits the operator to disconnect the rechargeable batteries 35 from the motor 29 from the exterior of the fuselage 23 and operates to resiliently bias the actuator 27 to its extreme counterclockwise motor "on" position during flight to assure that the actuator 27 will not interfere with normal operation of the bellcrank 39.

What is claimed is:

1. An electric powered model airplane comprising:

an electric motor mounted in the nose of said airplane, said motor including a short armature shaft extending through the nose of said airplane and supporting a driving propeller, said motor further including a pair of spring biased friction electrical contacts;

a rechargeable battery located in the fuselage of said airplane aft of the wings thereof;

a pair of nonconductive surfaces formed within the fuselage of said airplane adjacent to a pair of electrical terminals of said rechargeable battery;

a first semi-rigid conductor engaged at one end with one of said electrical contacts of said motor, extending from said one end to a position between one of said nonconductive surfaces and one of said pair of electrical battery terminals for contacting said one of said pair of battery terminals, and extending from said one of said battery terminals to a position outside the fuselage of said airplane for contact with a recharging source;

a second semi-rigid conductor engaged at one end with the other of said electrical contacts of said motor, and extending from said one end to form a resilient switch contact; and a third semi-rigid conductor having a first end positioned adjacent said resilient switch contact, extending from said first end to a position outside the fuselage of said airplane for contact with said recharging source, and extending from said position outside the fuselage to a second end positioned between the other of said pair of nonconductive surfaces and the other of said pair of electrical battery terminals for contacting said other of said pair of battery terminals.

2. An electric powered model airplane as defined in claim 1 wherein the fuselage of said airplane comprises:

a pair of adjacent indentations;

and wherein the portion of said first and third semi-rigid conductors extending outside the fuselage of said airplane each extend across one of said indentations for providing contact with a recharging source.

3. An electric powered model airplane as defined in claim 1 wherein said fuselage indentations have different depths to prohibit reverse polarization of said recharging source.

4. An electric powered model airplane as defined in claim 1 wherein that portion of said first and third semi-rigid conductors positioned to contact the terminals of said rechargeable battery are each bent to form a spring contact resiliently biased between one of said pair of battery terminals and one of said pair of nonconductive surfaces, said resilience assuring electrical contact between said conductors and said rechargeable battery and holding said battery in place within the fuselage of said model airplane.

5. An electric powered model airplane as defined in claim 1 wherein each of said first, second and third semi-rigid conductors is supported within the fuselage of said model airplane at spaced locations and is sufficiently rigid to be self-supporting between said spaced locations.

6. An electric powered model airplane comprising:

a motor mounted in said airplane for driving a propeller;

a rechargeable battery mounted in said airplane for energizing said motor, said battery having a negative and a positive terminal;

a removable source for recharging said rechargeable battery from outside said airplane, said removable source being an electric battery having a permanent negative and a positive terminal; and first, second and third conductive rods mounted in said airplane forming the sole electrical interconnection between said motor, said rechargeable battery and said removable recharging source, said first and said second conductive rods having adjacent ends forming contacts for a switch to selectively connect said motor to said rechargeable battery, said second conductive rod directly contacting both the positive terminal of said rechargeable battery and the positive terminal of said removable recharging source, and said third conductive rod directly contacting both the negative terminal of said rechargeable battery and the negative terminal of said removable recharging source.

7. An electric powered model airplane as defined in claim 6 wherein two of said three conductive rods which electrically interconnect rechargeable battery are bent to form resilient spring contacts for the terminals of said battery, said spring contacts partially supporting said rechargeable battery.

8. An electric powered model airplane as defined in claim 6 wherein one of said two adjacent conductive rod ends forming switch contacts is resilient to bias said switch to a closed circuit configuration.

9. An electric powered model airplane as defined in claim 6 wherein each of said three conductive rods is connected at spaced locations to said model airplane, said conductive rods being sufficiently rigid to be self-supporting between said spaced locations.

10. An electric powered model airplane as defined in claim 6 wherein said motor is mounted in the nose of said airplane and wherein said rechargeable battery is mounted within said airplane aft of the wings of said airplane to counterbalance the weight of said nose mounted motor.

11. An electric powered model airplane comprising:

a pair of control lines for controlling the flight of said airplane from a remote location;

a bellcrank mounted within said airplane, attached to said pair of control lines and connected to adjust the position of an elevator of said airplane;

a battery mounted within said airplane;

an electric motor mounted within said airplane for driving the propeller thereof, said motor energized by said battery;

a switch mounted within said airplane electrically connected to said electric motor and said battery to selectively interconnect the motor to the battery, said switch comprising:

a stationary contact; and a resilient, movable contact, said resilient contact biased toward a closed circuit configuration; and a switch actuator extending from a position adjacent said bellcrank to a position outside said airplane, said actuator having a first position maintained by the bias of said resilient, movable contact for opening said switch and a second position for closing said switch, said switch actuator positioned to be moved by said bellcrank from said first to said second position but not from said second to said first position.

12. An electric powered model airplane as defined in claim 11 wherein said switch actuator, when in said first position, is removed from the normal path of movement of said bellcrank.

13. An electric powered model airplane as defined in claim 11 wherein said battery is mounted aft of the wings of said airplane and wherein said electric motor is mounted in the nose of said airplane, the armature shaft of said motor supporting the propeller of said airplane.

14. An electric powered model airplane as defined in claim 11 wherein said switch actuator is additionally maintained by the bias of said resilient movable contact in said second position.

15. In an electric powered model airplane having a rotatable bellcrank for remote controlled flight and a resilient contact switch for interconnecting an internally mounted battery to an electric motor, the improvement comprising:

a switch actuator movably mounted on said airplane between a first position opening said switch and a second position closing said switch, said actuator extending outside said airplane to permit manipulation thereof, said actuator held in both said first and second positions by the resilience of said resilient spring contact; and means on said bellcrank for overcoming the resilience of said spring to move said actuator from said first to second position.

16. An electric powered model airplane as defined in claim 15 wherein said means on said bellcrank comprises a surface for contacting and moving said switch actuator, said surface of said bellcrank having a normal path of movement during controlled flight of said aircraft, said switch actuator in said second position being out of the normal path of movement of said bellcrank surface.

17. An electric powered model airplane as defined in claim 15 wherein said means on said bellcrank for overcoming the resilience of said spring is incapable of moving said actuator from said second position to said first position.

18. A rechargeable electric powered model airplane, comprising:

a pair of fuselage indentations adjacent one another;

a pair of electrical conductors, one positioned in each of said indentations;

a rechargeable battery mounted within said airplane and connected to said pair of electrical conductors;

a recharging battery including terminals for extending into said pair of indentations, said terminals mounted unsymmetrically on said recharging battery; and means on said airplane removed from said indentations for prohibiting reverse polarity contact of said recharging battery terminals with said electrical conductors.

19. A rechargeable electric powered model airplane as defined in claim 18 wherein said prohibiting means comprises a surface extension on said model airplane.

20. A rechargeable electric powered model airplane as defined in claim 19 wherein said surface extension comprises a wheel of said airplane.

21. A rechargeable electric powered model airplane as defined in claim 18 wherein said terminals of said recharging battery comprise spring contact members for resiliently contacting said pair of electrical conductors.

22. A rechargeable electric powered model airplane conprising:

a rechargeable battery mounted within said airplane and connected to drive said airplane;

a pair of electrical conductors attached to said rechargeable battery and extending outside the fuselage of said model airplane at spaced locations;

a recharging battery removable from said airplane, said recharging battery including a pair of terminals in the form of resilient springs, said terminals being separated by a distance equal to the separation of said spaced locations to permit said recharging battery to be held against said pair of electrical conductors for recharging said rechargeable battery, said terminals mounted unsymmetrically on said recharging battery; and means positioned on said airplane for contacting said recharging battery and thereby prohibiting reverse polarity contact of said recharging battery terminals with said electrical conductors when said pair of resilient spring terminals are placed on said pair of conductors in a reverse orientation, said means clearing said battery when said pair of resilient spring terminals are placed on said pair of conductors in a proper orientation.

23. A rechargeable electric powered model airplane as defined in claim 22 wherein said recharging battery terminals are mounted on a face of said recharging battery, one of said recharging battery terminals centrally mounted on said face and the remaining terminal mounted at one edge of said face, the opposite edge of said face contacting said surface irregularity means for prohibiting reverse polarization connection.

* * * * *